US011125480B2

(12) United States Patent
Sullivan et al.

(10) Patent No.: US 11,125,480 B2
(45) Date of Patent: Sep. 21, 2021

(54) SYSTEM AND METHOD FOR LUBRICANT SEPARATION AND RETURN CONTROL

(71) Applicant: TRANE INTERNATIONAL INC., Davidson, NC (US)

(72) Inventors: Kristin Rice Sullivan, La Crosse, WI (US); Eric S. Mlsna, Cashton, WI (US); Andrew Thomas Plzak, La Crescent, MN (US); James P. Crolius, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 104 days.

(21) Appl. No.: 16/517,324

(22) Filed: Jul. 19, 2019

(65) Prior Publication Data

US 2021/0018235 A1 Jan. 21, 2021

(51) Int. Cl.
*F25B 43/02* (2006.01)
*F25B 31/00* (2006.01)

(52) U.S. Cl.
CPC ..... *F25B 43/02* (2013.01); *F25B 31/004* (2013.01); *F25B 2400/075* (2013.01); *F25B 2500/16* (2013.01)

(58) Field of Classification Search
CPC ..... F25B 43/02; F25B 31/002; F25B 31/004; F25B 2500/16
See application file for complete search history.

(56) References Cited

U.S. PATENT DOCUMENTS 4,750,337 A * 6/1988 Glamm ..... F04B 39/0207 62/468
5,150,586 A * 9/1992 Basseggio ..... F16N 19/006 417/338
9,970,695 B2 5/2018 Hellmann et al.
2013/0177404 A1* 7/2013 Bernardi ..... F04D 29/00 415/168.1
2014/0037483 A1 2/2014 Fraser et al.
2017/0176074 A1* 6/2017 Crolius ..... F25B 49/022

FOREIGN PATENT DOCUMENTS

WO 2014/022198 A1 2/2014

OTHER PUBLICATIONS

Extended European Search Report, European Patent Application No. 20186738.9, dated Dec. 11, 2020 (7 pages).

* cited by examiner

*Primary Examiner* — Jonathan Bradford
(74) *Attorney, Agent, or Firm* — Hamre, Schumann, Mueller & Larson, P.C.

(57) ABSTRACT

An HVACR system includes first and second compressors arranged in parallel, a condenser, an expansion device, an evaporator, and a lubricant separator fluidly connected. The first compressor includes a first lubricant sump and a first suction inlet. The second compressor includes a second lubricant sump and a second suction inlet. The lubricant separator is disposed between the evaporator and the first and second compressors, and includes a fluid inlet and two fluid outlets. A first of the two fluid outlets is fluidly connected to at least one of the first and second lubricant sumps. A second of the two fluid outlets is fluidly connected to the first and second suction inlets. The second fluid outlet includes a nozzle disposed within a flow passage of the lubricant separator such that a space is maintained between an outer surface of the nozzle and an inner surface of the flow passage.

20 Claims, 6 Drawing Sheets

SYSTEM AND METHOD FOR LUBRICANT SEPARATION AND RETURN CONTROL

FIELD

This disclosure relates generally to heating, ventilation, air conditioning, and refrigeration (HVACR) systems. More specifically, the disclosure relates to systems and methods for controlling lubricant separation and return.

BACKGROUND

A heat transfer circuit for an HVACR system generally includes a compressor, a condenser, an expansion device, and an evaporator fluidly connected. The compressor typically includes rotating component(s) that are driven by motor(s). The HVACR system can include a rooftop unit to provide conditioned air to an air distribution system that includes ductwork. The heat transfer circuit can include a plurality of compressors. In an application, one or more of the plurality of compressors can be turned on or off during operation.

SUMMARY

This disclosure relates generally to HVACR systems. More specifically, the disclosure relates to systems and methods for controlling lubricant separation and return.

Embodiments disclosed herein are directed to lubricant management with a plurality of compressors connected in parallel. The plurality of compressors includes a compressor including a lubricant sump. The compressor is driven by a motor. In some embodiments, the lubricant sump is disposed at a relatively vertically lower portion of the compressor such that lubricant can be collected in the lubricant sump via gravitational force. In some embodiments, the lubricant is entrained in a heat transfer fluid of a heat transfer circuit of the HVACR system.

In some embodiments, the plurality of compressors can include first and second compressors. In some embodiments, the first compressor can be a variable speed compressor and the second compressor can be a fixed speed compressor. In some embodiments, both the first compressor and the second compressor can be fixed speed compressors.

In some embodiments, the plurality of compressors can include more than two compressors. In some embodiments, the plurality of compressors can include three compressors.

In some embodiments, the plurality of compressors can include four compressors. In some embodiments, the plurality of compressors includes at least one variable speed compressor.

A lubricant separator can be disposed between the evaporator and the plurality of compressors. The lubricant separator can be designed to control a flow of heat transfer fluid and lubricant to each of the compressors.

In some embodiments, the lubricant separator can separate the gaseous heat transfer fluid from the evaporator of the heat transfer circuit into a lubricant rich portion and a lubricant free portion. In some embodiments, the lubricant rich portion of the gaseous heat transfer fluid can be provided to a common conduit fluidly connected to the sumps of the plurality of compressors. In some embodiments, the lubricant free portion of the gaseous heat transfer fluid can be provided to a common suction duct fluidly connected to suction inlets of the plurality of compressors.

An HVACR system is disclosed. The system includes a first compressor, a second compressor, a condenser, an expansion device, an evaporator, and a lubricant separator fluidly connected. The first compressor and the second compressor are arranged in parallel. The first compressor includes a first lubricant sump and a first suction inlet. The second compressor includes a second lubricant sump and a second suction inlet. The lubricant separator is disposed between the evaporator and the first and second compressors. The lubricant separator includes a fluid inlet and two fluid outlets. A first of the two fluid outlets is fluidly connected to at least one of the first and second lubricant sumps. A second of the two fluid outlets is fluidly connected to the first and second suction inlets. The second fluid outlet includes a nozzle disposed within a flow passage of the lubricant separator such that a space (e.g., an annulus space) is maintained between an outer surface of the nozzle and an inner surface of the flow passage.

A method for separating and returning lubricant for an HVACR system is disclosed. The method includes separating a flow of a heat transfer fluid and lubricant mixture into a lubricant rich portion and a lubricant free portion. The method also includes directing the lubricant rich portion to at least one of a first lubricant sump of a first compressor and a second lubricant sump of a second compressor. The method further includes directing the lubricant free portion to a first suction inlet of the first compressor and a second suction inlet of the second compressor. The first and second compressors are arranged in parallel in a heat transfer circuit.

BRIEF DESCRIPTION OF THE DRAWINGS

References are made to the accompanying drawings that form a part of this disclosure and which illustrate embodiments in which the systems and methods described in this specification can be practiced.

Like reference numbers represent like parts throughout.

DETAILED DESCRIPTION

Figure 1A:
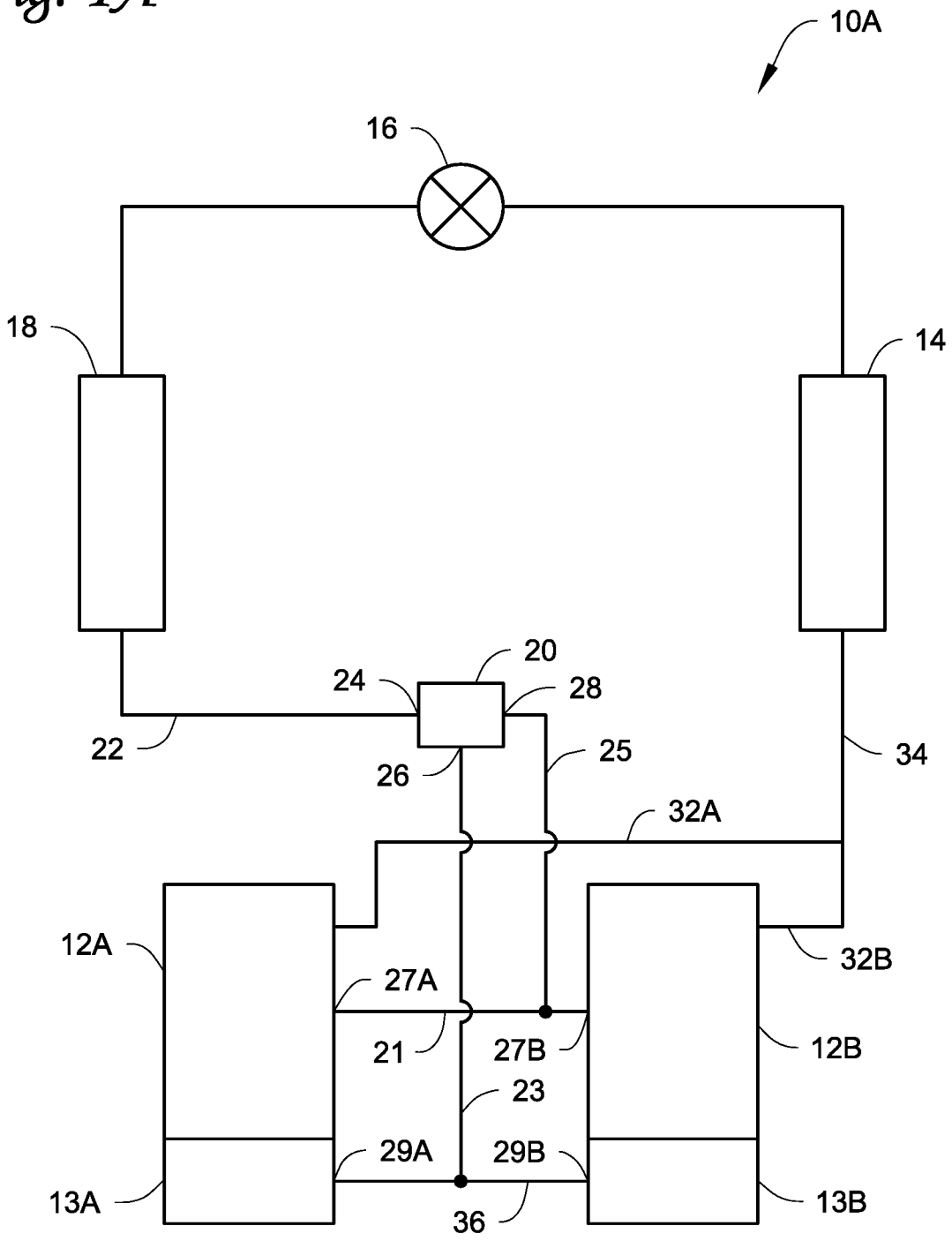
FIG. 1A is a schematic diagram of a heat transfer circuit, according to an embodiment.

This disclosure relates generally to HVACR systems. More specifically, the disclosure relates to systems and methods for controlling lubricant separation and return.

In some embodiments, a heat transfer circuit can include a plurality of compressors. The plurality of compressors can be connected in parallel in the heat transfer circuit. A common suction conduit can be fluidly connected to suction inlets of the plurality of compressors. A heat transfer fluid and lubricant mixture can flow through the common suction conduit and enter one or more of the suction inlets of the plurality of compressors. Each of the plurality of compressors can include a lubricant sump. Each compressor can be driven by a motor that is disposed in the same case/shell/container as the compressor. In some embodiments, the lubricant sump can be disposed at a relatively vertically lower portion of the compressor such that lubricant can be collected in the lubricant sump via gravitational force. In some embodiments, the lubricant can be entrained in a heat transfer fluid of a heat transfer circuit of the HVACR system. The lubricant can be accordingly provided to one or more the plurality of compressors via the corresponding suction inlet through the common suction conduit which provides gaseous heat transfer fluid from an evaporator of the heat transfer circuit to the plurality of compressors. The lubricant can flow around the motor of the compressor to return to the compressor sump. In some embodiments, the compressor motor can have bypass area with hydraulic diameters. In some embodiments, the bypass area of the motor can be defined as the area between the outer surface of the motor and the inner surface of the case/shell/container. In some embodiments, the bypass area of the motor and its hydraulic diameters can be limited due to e.g., the size and/design limitation of the compressor. The bypass area of the motor can allow the lubricant to flow from the suction cavity of the compressor to return to the compressor sump. In some embodiments, when one (or more) of the compressors is turned off, the manifold scheme of the heat transfer circuit cannot reliably return lubricant to the sump of the compressor(s) that is turned on. This is because the gaseous heat transfer fluid can flow through the compressor(s) that is turned off, and through a lubricant transfer conduit (e.g., a lubricant equalizer line), and flows up through the limited bypass area of the motor of the compressor(s) that is turned on. This can cause lubricant to stay in a suction cavity of the compressor rather than draining (down to the sump) around the bypass area of the motor. As such, when compressor(s) is staged off, there can be low lubricant levels in the compressor manifolds. In such embodiments, the compressor's internal geometry (e.g., limited bypass area of the motor and its limited hydraulic diameters) may prevent lubricant from draining down into the sump, especially when a large equalizer line (e.g., with a diameter that is equivalent to a diameter of the suction line) is used. In some embodiment, the bypass area of the motor can be increased to allow lubricant to drain (down to the sump) around the bypass area of the motor.

The embodiments disclosed herein can separate lubricant from the gaseous heat transfer fluid. A common suction conduit for the gaseous heat transfer fluid can be fluidly connected to suction inlets of the plurality of compressors. The embodiments disclosed herein can redirect the lubricant to a common lubricant conduit (e.g., a lubricant transfer conduit) which can be fluidly connected to the sumps of the plurality of compressors. The separation can result in a lubricant rich portion and a lubricant free portion.

A "lubricant rich portion," as used in this specification, includes a portion of a heat transfer fluid (e.g., refrigerant) and lubricant (e.g., oil) mixture that has a relatively higher concentration of lubricant compared to another portion of the heat transfer fluid flow.

A "lubricant free portion," as used in this specification, includes a portion of a heat transfer fluid and lubricant mixture that has a relatively lower concentration of lubricant compared to another portion of the heat transfer fluid flow. It will be appreciated that in some embodiments, the lubricant free portion may still include some lubricant. It will also be appreciated that in some embodiments, the lubricant free portion may not include lubricant.

In some embodiments, a lubricant separator (described later) can receive the suction gaseous heat transfer fluid flow. The lubricant separator can include a nozzle. The lubricant separator can prevent the lubricant rich portion (e.g., lubricant) from flowing into the suction inlets of the plurality of compressors but allow the lubricant free portion (e.g., gaseous heat transfer fluid) to pass through to the suction inlets of the compressors. The lubricant rich portion can flow down a tee (e.g., a T-shape connector) below the lubricant separator into a lubricant transfer conduit (e.g., a lubricant equalizer line), which connects the sumps of the compressors. As such, there can be no lubricant rich portion settling in the suction cavity of the compressor, and the lubricant rich portion can be instead delivered directly to the lubricant transfer conduit which feeds into the sumps of the compressors.

The embodiments disclosed herein can keep the lubricant rich portion (that returns from the heat transfer circuit) out of the suction conduit of the compressor and divert the lubricant rich portion directly (e.g., via a lubricant transfer conduit that is separated from the suction conduit) to the sump of the compressor, to avoid requiring the lubricant rich portion to drain around the bypass area of the compressor motor.

FIG. 1A is a schematic diagram of a heat transfer circuit 10A, according to an embodiment. The heat transfer circuit 10A generally includes a plurality of compressors 12A, 12B, a condenser 14, an expansion device 16, and an evaporator 18. The expansion device 16 allows the working fluid to expand. The expansion causes the working fluid to significantly decrease in temperature. An "expansion device" as described herein may also be referred to as an expander. In an embodiment, the expander may be an expansion valve, expansion plate, expansion vessel, orifice, or the like, or other such types of expansion mechanisms. It should be appreciated that the expander may be any type of expander used in the field for expanding a working fluid to cause the working fluid to decrease in temperature. The heat transfer circuit 10A is exemplary and can be modified to include additional components. For example, in some embodiments the heat transfer circuit 10A can include other components such as, but not limited to, an economizer heat exchanger, one or more lubricant separators, a receiver tank, a dryer, a suction-liquid heat exchanger, or the like.

The heat transfer circuit 10A can generally be applied in a variety of systems used to control an environmental condition (e.g., temperature, humidity, air quality, or the like) in a space (generally referred to as a conditioned space). Examples of systems include, but are not limited to, HVACR systems, transport refrigeration systems, or the like.

The components of the heat transfer circuit 10A are fluidly connected. The heat transfer circuit 10A can be specifically configured to be a cooling system (e.g., an air conditioning system) capable of operating in a cooling mode. Alternatively, the heat transfer circuit 10A can be specifically configured to be a heat pump system which can operate in both a cooling mode and a heating/defrost mode.

The heat transfer circuit 10A can operate according to generally known principles. The heat transfer circuit 10A can be configured to heat or cool a heat transfer fluid or medium (e.g., a liquid such as, but not limited to, water or the like), in which case the heat transfer circuit 10A may be generally representative of a liquid chiller system. The heat transfer circuit 10A can alternatively be configured to heat or cool a heat transfer fluid or medium (e.g., a gas such as, but not limited to, air or the like), in which case the heat transfer circuit 10A may be generally representative of an air conditioner or heat pump.

In operation, the compressors 12A, 12B compress a heat transfer fluid (e.g., refrigerant or the like) from a relatively lower pressure gas to a relatively higher-pressure gas. The relatively higher-pressure and higher temperature gas is discharged from the compressors 12A, 12B and flows through the condenser 14. In accordance with generally known principles, the heat transfer fluid flows through the condenser 14 and rejects heat to a heat transfer fluid or medium (e.g., water, air, etc.), thereby cooling the heat transfer fluid. The cooled heat transfer fluid, which is now in a liquid form, flows to the expansion device 16. The expansion device 16 reduces the pressure of the heat transfer fluid. As a result, a portion of the heat transfer fluid is converted to a gaseous form. The heat transfer fluid, which is now in a mixed liquid and gaseous form flows to the evaporator 18. The heat transfer fluid flows through the evaporator 18 and absorbs heat from a heat transfer fluid or medium (e.g., water, air, etc.), heating the heat transfer fluid, and converting it to a gaseous form. The gaseous heat transfer fluid then returns to the compressors 12A, 12B. The above-described process continues while the heat transfer circuit 10A is operating, for example, in a cooling mode (e.g., while the compressors 12A, 12B are enabled).

The compressors 12A, 12B can be, for example, but are not limited to, scroll compressors. In some embodiments, the compressors 12A, 12B can be other types of compressors. Examples of other types of compressors include, but are not limited to, reciprocating compressors, positive displacement compressors, or other types of compressors suitable for use in the heat transfer circuit 10A and having a lubricant sump. The compressor 12A can be generally representative of a variable speed compressor and the compressor 12B can be generally representative of a fixed speed compressor. In some embodiments, both the compressor 12A and the compressor 12B can be fixed speed compressors. In some embodiments, the compressors 12A, 12B can alternatively be step control compressors (e.g., compressors having two or more steps within a compressor). In some embodiments, the compressors 12A, 12B can be compressors having different capacities. For example, compressor 12A can have a relatively greater capacity than compressor 12B, according to some embodiments. It will be appreciated that alternatively the compressor 12B can have a relatively greater capacity than compressor 12A.

The compressors 12A, 12B are connected in parallel in the heat transfer circuit 10A. Accordingly, the gaseous heat transfer fluid exiting the evaporator 18 is provided via a conduit 22 (e.g., a suction line) to each of the compressors 12A, 12B. A lubricant separator 20 receives the gaseous heat transfer fluid at a fluid inlet 24 and provides the gaseous heat transfer fluid to a common lubricant transfer conduit 23 via a first fluid outlet 26 and to a common suction conduit 25 via a second fluid outlet 28. The lubricant separator 20, according to some embodiments, is discussed in additional details in accordance with FIG. 2 below. Following compression, the relatively higher-pressure and higher-temperature gas is discharged from compressor 12A via discharge conduit 32A and from compressor 12B via discharge conduit 32B. In some embodiments, the discharge conduits 32A, 32B of the compressors 12A, 12B are joined at discharge conduit 34 to provide the combined relatively higher-pressure and higher temperature gas to the condenser 14.

The heat transfer fluid in the heat transfer circuit 10A generally includes a lubricant entrained with the heat transfer fluid. The lubricant is provided to the compressors 12A, 12B for example to lubricate bearings and seal leak paths of the compressors 12A, 12B. When the relatively higher-pressure and higher-temperature heat transfer fluid is discharged from the compressors 12A, 12B, the heat transfer fluid generally carries along with it a portion of the lubricant which is initially delivered to the compressors 12A, 12B with the heat transfer fluid that enters the compressors 12A, 12B via a conduit 22. A portion of the lubricant is maintained in the lubricant sumps 13A, 13B of the compressors 12A, 12B.

The lubricant separator 20 can separate lubricant from the gaseous heat transfer fluid in the heat transfer fluid and lubricant mixture from the conduit 22. The separation can result in a lubricant rich portion (lubricant generally flows along the pipe/line walls) and a lubricant free portion. The lubricant separator 20 is disposed on the conduit 22, with a branch facing down (to direct the lubricant to the sump(s)). The lubricant separator 20 has a nozzle structure with a reduced diameter pointing against the direction of the flow of the heat transfer fluid. The common suction conduit 25 (that is fluidly connected to the second fluid outlet 28) is fluidly connected to suction conduit(s) 21. A connector (e.g., a T-shape connector, not shown) can connect the common suction conduit 25 to the suction conduit(s) 21. The suction conduit(s) 21 is fluidly connected to a suction inlet 27A of the compressor 12A and a suction inlet 27B of the compressor 12B.

The lubricant sumps 13A, 13B of the compressors 12A, 12B are fluidly connected via a lubricant transfer conduit 36. The lubricant transfer conduit 36 is disposed at a lubricant level of the lubricant sumps 13A, 13B which permits lubricant to flow between the compressor 12A and the compressor 12B. Fluid flow of the lubricant is controlled by a pressure differential between the lubricant sump 13A of the compressor 12A and the lubricant sump 13B of the compressor 12B. As a result, if operation of the compressor 12A or 12B is modified, the fluid flow of the lubricant between the compressors 12A, 12B can be affected. In some embodiments, a desired pressure differential can be selected such that flow of lubricant in the lubricant sump 13A is induced to lubricant sump 13B at a variety of compressor 12A, 12B operating conditions. In some embodiments, the desired pressure differential can alternatively be referred to as a target pressure differential. In some embodiments, the desired pressure differential can be a minimum pressure differential at which flow of lubricant from the lubricant sump 13A will be induced to the lubricant sump 13B. In some embodiments, the desired pressure differential can be a minimum pressure differential where flow to the compressor 12A can be defined at a maximum compressor speed and flow to the compressor 12B can be defined at a minimum suction flow corresponding to a low suction temperature. Other operating conditions where the compressor 12B is running can generally yield a higher pressure differential.

In some embodiments, a diameter of the lubricant transfer conduit 36 can be relatively smaller in diameter as compared to other lubricant transfer conduits depending on the application intended. In some embodiments, the relatively smaller diameter can be selected to restrict a flow of heat transfer fluid from the lubricant sump 13A to the lubricant sump 13B. In some embodiments, a relatively smaller diameter lubricant transfer conduit 36 can, for example, prevent a pressure in the lubricant sump 13A and a pressure in the lubricant sump 13B from equalizing. In some embodiments, this can, for example, maintain a pressure differential between the lubricant sumps 13A, 13B to maintain a flow of lubricant between the lubricant sumps 13A, 13B. In some embodiments, the compressors 12A, 12B may be designed to include an outlet having a diameter designed to fit the relatively larger diameter lubricant transfer conduit. In such embodiments, an adapter (not shown) can be used to connect the relatively smaller diameter lubricant transfer conduit 36 to the compressors 12A, 12B.

In some embodiments, the lubricant transfer conduit 36 can be a lubricant equalizer line configured to equalize a pressure in the lubricant sump 13A and a pressure in the lubricant sump 13B.

The common lubricant transfer conduit 23 (that is fluidly connected to the first fluid outlet 26) is fluidly connected to the lubricant transfer conduit 36. A connector (e.g., a T-shape connector, not shown) can connect the common lubricant transfer conduit 23 to the lubricant transfer conduit 36. The lubricant transfer conduit 36 is fluidly connected to the lubricant sump 13A via a sump inlet 29A of the compressor 12A and with the lubricant sump 13B via a sump inlet 29B of the compressor 12B. It will be appreciated that in some embodiments, 29A and/or 29B can be inlets for receiving lubricant (e.g., receiving lubricant from the common lubricant transfer conduit 23 via the first fluid outlet 26 or from the compressor having higher pressure in the lubricant sump). In some embodiments, 29A and/or 29B can be outlets for transferring lubricant (to the compressor having lower pressure in the lubricant sump).

Figure 1B:
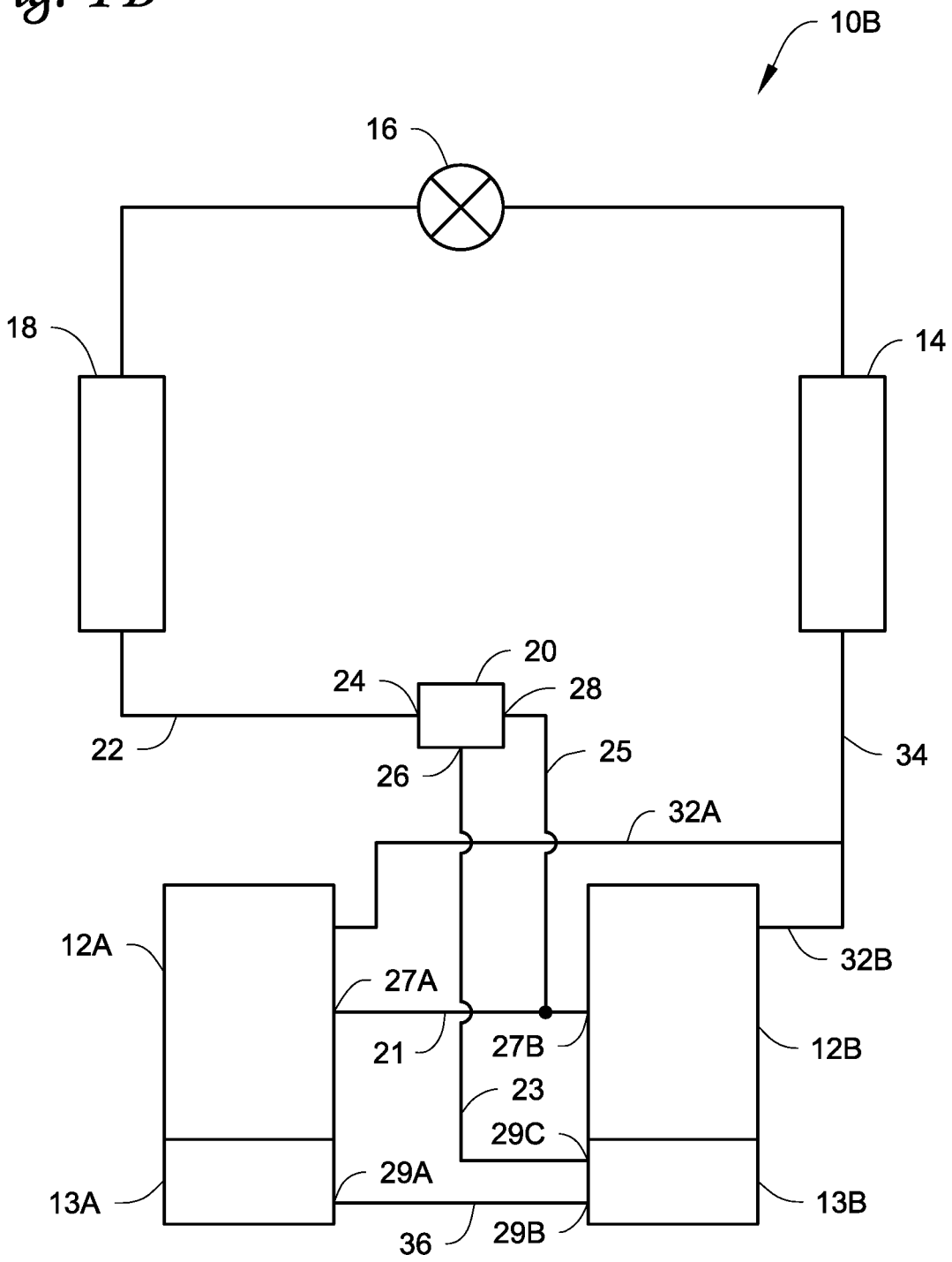
FIG. 1B is a schematic diagram of a heat transfer circuit, according to another embodiment.

FIG. 1B is a schematic diagram of a heat transfer circuit 10B, according to another embodiment. The heat transfer circuit 10B is similar to the heat transfer circuit 10A shown in FIG. 1A. Differences between the heat transfer circuit 10B from the heat transfer circuit 10A are described below.

The lubricant separator 20 receives the gaseous heat transfer fluid at the fluid inlet 24 and provides the gaseous heat transfer fluid to the lubricant transfer conduit 23 (the first lubricant transfer conduit) via the first fluid outlet 26. The lubricant transfer conduit 23 (that is fluidly connected to the first fluid outlet 26) is fluidly connected to a sump inlet 29C of the lubricant sump 13B of the compressor 12B. In this embodiment, the lubricant sump 13B has a higher operation pressure than the lubricant sump 13A. In an embodiment, the lubricant transfer conduit 23 has a diameter smaller than, e.g., a diameter of the suction line (e.g., suction conduit 21). In an embodiment, the lubricant transfer conduit 36 (the second lubricant transfer conduit) has a diameter smaller than, e.g., a diameter of the suction line (e.g., suction conduit 21). The lubricant transfer conduit 36 connects between the lubricant sump (13B) that has a higher operating pressure (than that of 13A) and the lubricant sump (13A) that has a lower operation pressure (than that of 13B). As such, lubricant can flow from lubricant sump (e.g., 13B) having a higher operating pressure to the lubricant sump (e.g., 13A) having a lower operating pressure. It will be appreciated that this process can be repeated for additional compressors to "cascade" lubricant from higher pressure sumps to lower pressure sumps, as long as only two compressors are connected per lubricant transfer conduit (e.g., 36, the second lubricant transfer conduit), in order of decreasing sump pressures. It will be appreciated that the first lubricant transfer conduit and the second lubricant transfer conduit can be separate/independent conduits.

The lubricant transfer conduit 36 is fluidly connected to the lubricant sump 13A via a sump outlet 29B of the compressor 12B and with the lubricant sump 13A via a sump inlet 29A of the compressor 12A. It will be appreciated that in some embodiments, 29A and/or 29B can be inlets for receiving lubricant (e.g., receiving lubricant from the compressor having higher pressure in the lubricant sump). In some embodiments, 29A and/or 29B can be outlets for transferring lubricant (to the compressor having lower pressure in the lubricant sump).

The lubricant sumps 13A, 13B of the compressors 12A, 12B are fluidly connected via the lubricant transfer conduit 36. The lubricant transfer conduit 36 is disposed at a lubricant level of the lubricant sumps 13A, 13B which permits lubricant to flow between the compressor 12A and the compressor 12B. Fluid flow of the lubricant is controlled by a pressure differential between the lubricant sump 13A of the compressor 12A (downstream compressor, with a lower pressure in the lubricant sump 13A than the pressure of the lubricant sump 13B) and the lubricant sump 13B of the compressor 12B (upstream compressor, with a higher pressure in the lubricant sump 13B than the pressure of the lubricant sump 13A). As a result, if operation of the compressor 12A or 12B is modified, the fluid flow of the lubricant between the compressors 12A, 12B can be affected. In some embodiments, a desired pressure differential can be selected such that flow of lubricant in the lubricant sump 13B is induced to lubricant sump 13A at a variety of compressor 12A, 12B operating conditions. In some embodiments, the desired pressure differential can alternatively be referred to as a target pressure differential. In some embodiments, the desired pressure differential can be a minimum pressure differential at which flow of lubricant from the lubricant sump 13B will be induced to the lubricant sump 13A. In some embodiments, the desired pressure differential can be a minimum pressure differential where flow to the upstream compressor 12B can be defined at a maximum compressor speed and flow to the downstream compressor 12A can be defined at a minimum suction flow corresponding to a low suction temperature. Other operating conditions where the downstream compressor 12A is running can generally yield a higher pressure differential.

In some embodiments, a diameter of the lubricant transfer conduit 36 can be relatively smaller in diameter as compared to other lubricant transfer conduits depending on the application intended. In some embodiments, the relatively smaller diameter can be selected to restrict a flow of heat transfer fluid from the lubricant sump 13B to the lubricant sump 13A. In some embodiments, a relatively smaller diameter lubricant transfer conduit 36 can, for example, prevent a pressure in the lubricant sump 13B and a pressure in the lubricant sump 13A from equalizing. In some embodiments, this can, for example, maintain a pressure differential between the lubricant sumps 13A, 13B to maintain a flow of lubricant between the lubricant sumps 13A, 13B. In some embodiments, the compressors 12A, 12B may be designed to include an outlet having a diameter designed to fit the relatively larger diameter lubricant transfer conduit. In such embodiments, an adapter (not shown) can be used to connect the relatively smaller diameter lubricant transfer conduit 36 to the compressors 12A, 12B.

In some embodiments, the lubricant transfer conduit 36 can be a lubricant equalizer line configured to equalize a pressure in the lubricant sump 13A and a pressure in the lubricant sump 13B.

Figure 1C:
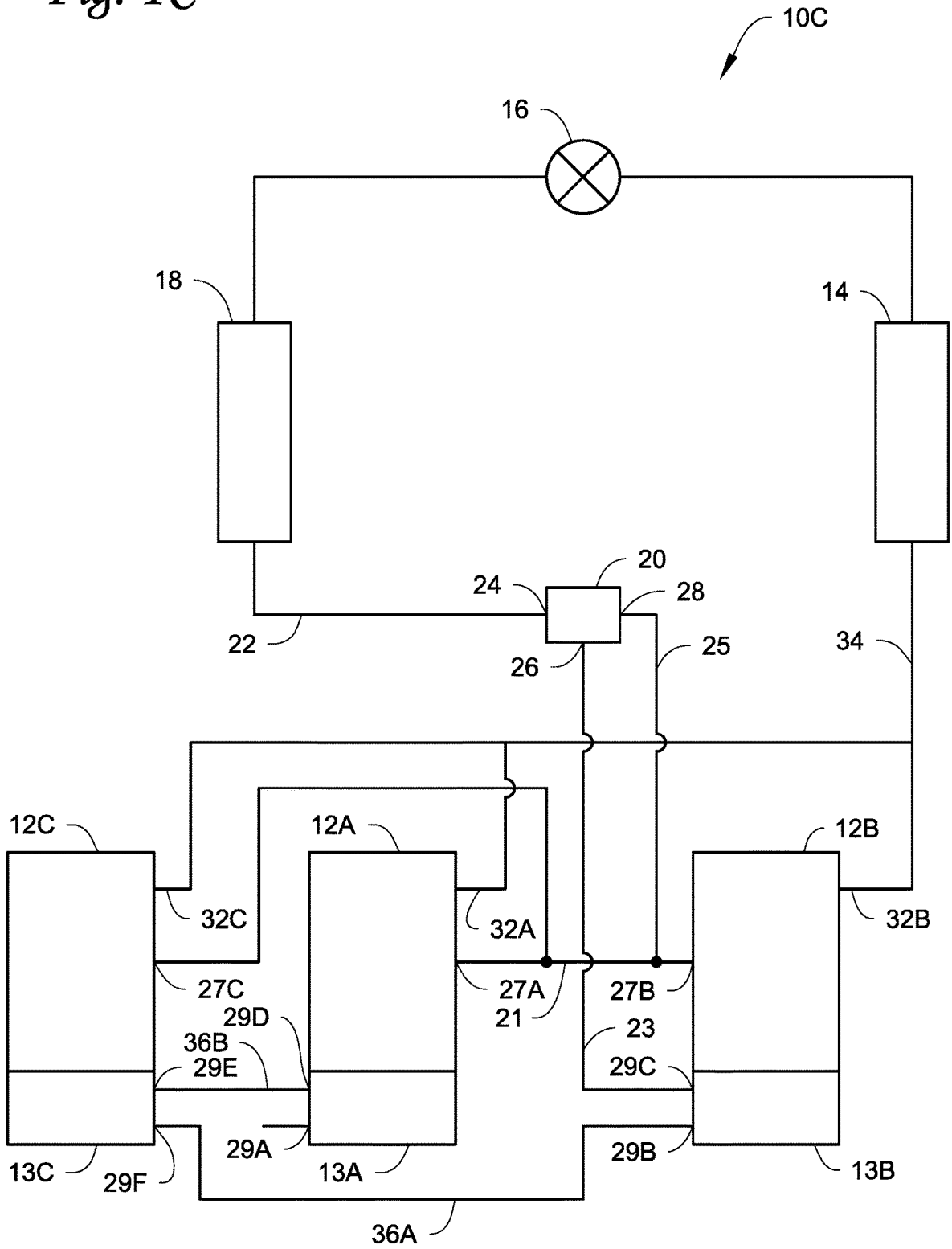
FIG. 1C is a schematic diagram of a heat transfer circuit, according to yet another embodiment.

FIG. 1C is a schematic diagram of a heat transfer circuit 10C, according to yet another embodiment. The heat transfer circuit 10C is similar to the heat transfer circuit 10B shown in FIG. 1B. Differences between the heat transfer circuit 10C from the heat transfer circuit 10B are described below.

The heat transfer circuit 10C includes a third compressor 12C. The compressors 12A, 12B, and 12C are connected in parallel in the heat transfer circuit 10C. Accordingly, the gaseous heat transfer fluid exiting the evaporator 18 is provided via a conduit 22 to each of the compressors 12A, 12B, and 12C. A lubricant separator 20 receives the gaseous heat transfer fluid at a fluid inlet 24 and provides the gaseous heat transfer fluid to a lubricant transfer conduit 23 (the first lubricant transfer conduit) via a first fluid outlet 26 and to a common suction conduit 25 via a second fluid outlet 28. The lubricant separator 20, according to some embodiments, is discussed in additional details in accordance with FIG. 2 below. Following compression, the relatively higher-pressure and higher-temperature gas is discharged from compressor 12A via discharge conduit 32A, from compressor 12B via discharge conduit 32B, and from compressor 12C via discharge conduit 32C. In some embodiments, the discharge conduits 32A, 32B, 32C of the compressors 12A, 12B, 12C are joined at discharge conduit 34 to provide the combined relatively higher-pressure and higher temperature gas to the condenser 14. For example, the discharge conduits 32A and 32B can be joined (e.g., using a T-shape connector), and then the joined discharge conduit (of 32A and 32B) can be joined with discharge conduit 32C (e.g., using a T-shape connector). The discharge conduits 32A and 32C can be joined, and then the joined conduit and 32B can be joined. The discharge conduits 32C and 32B can be joined, and then the joined conduit and 32A can be joined.

The common suction conduit 25 (that is fluidly connected to the second fluid outlet 28) is fluidly connected to suction conduit(s) 21. A connector (e.g., a T-shape connector, not shown) can connect the common suction conduit 25 to the suction conduit(s) 21. The suction conduit(s) 21 is fluidly connected to a suction inlet 27A of the compressor 12A, a suction inlet 27B of the compressor 12B, and a suction inlet 27C of the compressor 12C using connectors (e.g., T-shape connectors, not shown).

The lubricant separator 20 receives the gaseous heat transfer fluid at the fluid inlet 24 and provides the gaseous heat transfer fluid to the lubricant transfer conduit 23 via the first fluid outlet 26. The lubricant transfer conduit 23 (that is fluidly connected to the first fluid outlet 26) is fluidly connected to a sump inlet 29C of the lubricant sump 13B of the compressor 12B.

In this embodiment, the lubricant sump 13B has a highest operation pressure among the lubricant sumps 13A, 13B, and 13C. In an embodiment, the lubricant transfer conduit 23 has a diameter smaller than, e.g., a diameter of the suction line (e.g., suction conduit 21). In an embodiment, the lubricant transfer conduit (36A and 36B, the second lubricant transfer conduit and the third lubricant transfer conduit) has a diameter smaller than, e.g., a diameter of the suction line (e.g., suction conduit 21). The lubricant transfer conduit 36A (the second lubricant transfer conduit) connects between the lubricant sump (13B) that has a higher operating pressure (than that of 13A) and the lubricant sump (13A) that has a lower operation pressure (than that of 13B). The lubricant transfer conduit 36B (the third lubricant transfer conduit) connects between the lubricant sump (13A) that has a higher operating pressure (than that of 13C) and the lubricant sump (13C) that has a lower operation pressure (than that of 13A).

As such, lubricant can flow from the lubricant transfer conduit 23 to the lubricant sump (e.g., 13B) having a highest operating pressure, then to the lubricant sump (e.g., 13A) having a second highest operating pressure, and then to the lubricant sump (e.g., 13C) having a lowest operating pressure. It will be appreciated that this process can be repeated for additional compressors (fourth, fifth, etc. that also connected in parallel in the heat transfer circuit) to "cascade" lubricant from higher pressure sumps to lower pressure sumps, as long as only two compressors are connected per lubricant transfer conduit (e.g., 36A, 36B, etc.), in order of decreasing sump pressures. It will be appreciated that the first lubricant transfer conduit, the second lubricant transfer conduit, and the third lubricant transfer conduit can be separate/independent conduits.

The lubricant transfer conduit 36A is fluidly connected to the lubricant sump 13B via a sump outlet 29B of the compressor 12B and with the lubricant sump 13A via a sump inlet 29A of the compressor 12A. The lubricant transfer conduit 36B is fluidly connected to the lubricant sump 13A via a sump outlet 29D of the compressor 12A and with the lubricant sump 13C via a sump inlet 29E of the compressor 12C. It will be appreciated that in some embodiments, 29A and/or 29B and/or 29D and/or 29E can be inlets for receiving lubricant (e.g., receiving lubricant from the compressor having higher pressure in the lubricant sump). In some embodiments, 29A and/or 29B and/or 29D and/or 29E can be outlets for transferring lubricant (to the compressor having lower pressure in the lubricant sump).

The lubricant sumps 13A, 13B of the compressors 12A, 12B are fluidly connected via the lubricant transfer conduit 36A. The lubricant sumps 13A, 13C of the compressors 12A, 12C are fluidly connected via the lubricant transfer conduit 36B. The lubricant transfer conduit 36A is disposed at a lubricant level of the lubricant sumps 13A, 13B which permits lubricant to flow between the compressor 12A and the compressor 12B. The lubricant transfer conduit 36B is disposed at a lubricant level of the lubricant sumps 13A, 13C which permits lubricant to flow between the compressor 12A and the compressor 12C.

Fluid flow of the lubricant is controlled by a pressure differential between the lubricant sump 13A of the compressor 12A (downstream compressor, with a lower pressure in the lubricant sump 13A than the pressure of the lubricant sump 13B) and the lubricant sump 13B of the compressor 12B (upstream compressor, with a higher pressure in the lubricant sump 13B than the pressure of the lubricant sump 13A). Fluid flow of the lubricant is controlled by a pressure differential between the lubricant sump 13A of the compressor 12A (upstream compressor, with a higher pressure in the lubricant sump 13A than the pressure of the lubricant sump 13C) and the lubricant sump 13C of the compressor 12C (downstream compressor, with a lower pressure in the lubricant sump 13C than the pressure of the lubricant sump 13A).

As a result, if operation of the compressor 12A and/or 12B and/or 12C is modified, the fluid flow of the lubricant between the compressors 12A, 12B and/or between the compressors 12A and 12C can be affected. In some embodiments, a desired pressure differential can be selected such that flow of lubricant in the lubricant sump 13B is induced to lubricant sump 13A at a variety of compressor 12A, 12B operating conditions. In some embodiments, a desired pressure differential can be selected such that flow of lubricant in the lubricant sump 13A is induced to lubricant sump 13C at a variety of compressor 12A, 12C operating conditions.

In some embodiments, the desired pressure differential can alternatively be referred to as a target pressure differential. In some embodiments, the desired pressure differential can be a minimum pressure differential at which flow of lubricant from the lubricant sump 13B will be induced to the lubricant sump 13A (and/or flow of lubricant from the lubricant sump 13A will be induced to the lubricant sump 13C). In some embodiments, the desired pressure differential can be a minimum pressure differential where flow to the upstream compressor 12B can be defined at a maximum compressor speed and flow to the downstream compressor 12A can be defined at a minimum suction flow corresponding to a low suction temperature. In some embodiments, the desired pressure differential can be a minimum pressure differential where flow to the upstream compressor 12A can be defined at a maximum compressor speed and flow to the downstream compressor 12C can be defined at a minimum suction flow corresponding to a low suction temperature. Other operating conditions where the downstream compressor 12A (or downstream compressor 12C) is running can generally yield a higher pressure differential.

In some embodiments, a diameter of the lubricant transfer conduit (36A and/or 36B) can be relatively smaller in diameter as compared to other lubricant transfer conduits depending on the application intended. In some embodiments, the relatively smaller diameter can be selected to restrict a flow of heat transfer fluid from the lubricant sump 13B to the lubricant sump 13A (and/or from the lubricant sump 13A to the lubricant sump 13C). In some embodiments, a relatively smaller diameter lubricant transfer conduit (36A, 36B) can, for example, prevent a pressure in the lubricant sump 13B and a pressure in the lubricant sump 13A (and/or a pressure in the lubricant sump 13C and a pressure in the lubricant sump 13A) from equalizing. In some embodiments, this can, for example, maintain a pressure differential between the lubricant sumps 13A, 13B (or 13A, 13C) to maintain a flow of lubricant between the lubricant sumps 13A, 13B (or 13A, 13C). In some embodiments, the compressors 12A, 12B, 12C may be designed to include an outlet having a diameter designed to fit the relatively larger diameter lubricant transfer conduit. In such embodiments, an adapter (not shown) can be used to connect the relatively smaller diameter lubricant transfer conduit (36A, 36B) to the compressors 12A, 12B, 12C.

In some embodiments, the lubricant transfer conduit (36A, 36B) can be a lubricant equalizer line configured to equalize a pressure in the lubricant sump 13A and a pressure in the lubricant sump 13B (and/or a pressure in the lubricant sump 13A and a pressure in the lubricant sump 13C).

Embodiments disclosed herein can help directing lubricant into the lubricant sump instead of rerunning lubricant through the suction line. Lubricant can be first separated from the suction line (e.g., via a lubricant separator 20) and diverted through a dedicated lubricant return line, and into the compressor sump with the highest sump pressure in the heat transfer circuit. Lubricant can be routed first to the sump with the highest pressure, and then be driven in the direction of decreasing pressure. Multiple compressors can then be connected (in parallel) in this cascaded order, whilst lubricant can be driven from higher to lower pressure sumps. Lubricant can be transferred as long as there is a pressure differential between the compressor sumps (connected via lubricant transfer conduit) and sufficient lubricant levels exist.

It would be appreciated that in an embodiment, the heat transfer circuit can have one compressor. In such embodiment, lubricant can be directed to the compressor sump from the lubricant separator via a lubricant transfer conduit.

Embodiments disclosed herein use smaller lubricant transfer conduit (e.g., lubricant transfer conduit having a diameter smaller than, e.g., a diameter of the suction line to direct lubricant into the highest pressure compressor sump, and/or to connect between the compressor sumps that have different pressure (to allow lubricant to move from a sump with a higher pressure to a sump with a lower pressure).

Embodiments disclosed herein can effectively manage lubricant levels throughout all load steps and conditions. Lab testing shows that with the embodiment disclosed herein, compressor reliability can be improved at all lubricant levels.

Figure 2:
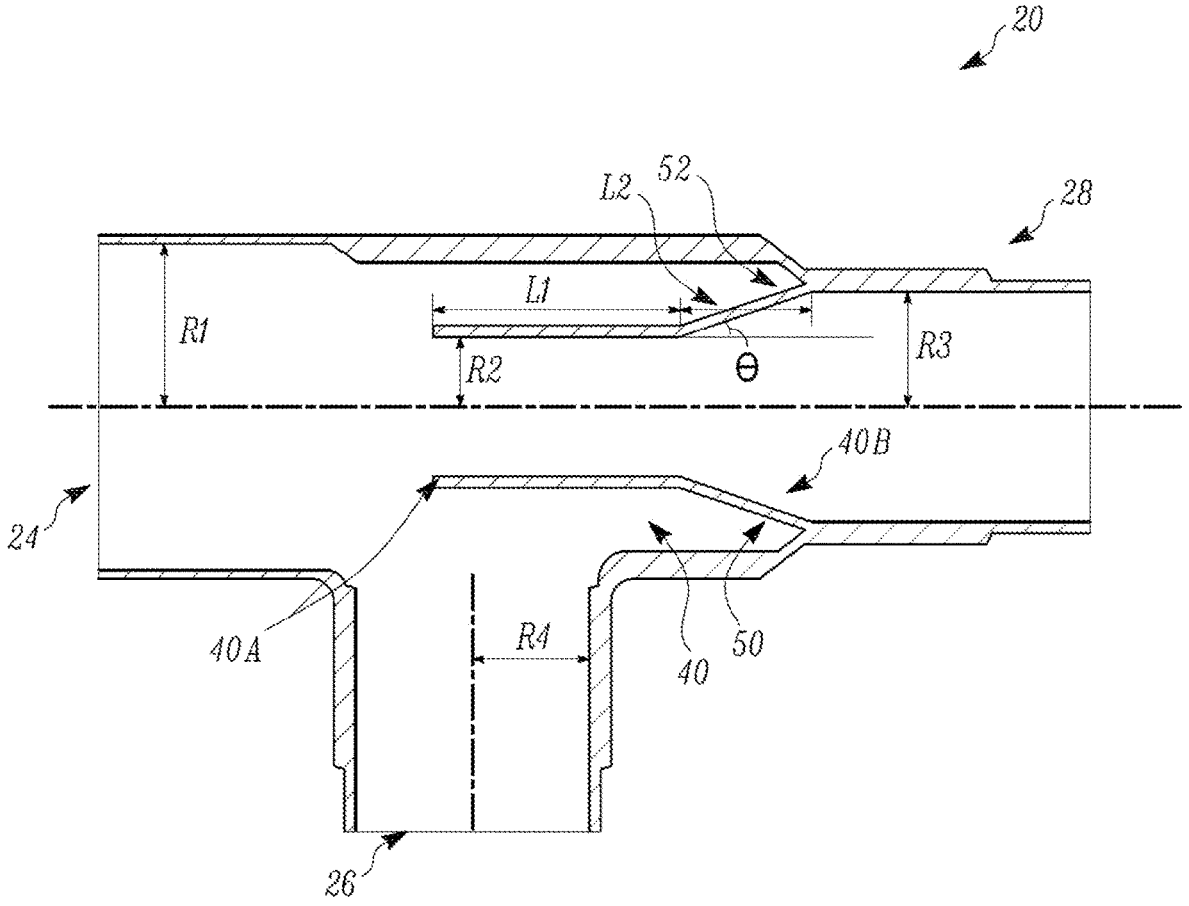
FIG. 2 is a sectional view of a lubricant separator for use in the heat transfer circuit of FIGS. 1A-1C, according to an embodiment.

FIG. 2 is a sectional view of the lubricant separator 20, according to some embodiments. In operation, heat transfer fluid in conduit 22 (FIGS. 1A-1C) is provided to the fluid inlet 24 of the lubricant separator 20. In some embodiments, the fluid inlet 24 can be part of the conduit 22.

In general, lubricant in the heat transfer fluid and lubricant mixture is more concentrated on the perimeter of the fluid inlet 24, and less concentrated toward the center of the fluid inlet 24. Lubricant in the heat transfer fluid and lubricant mixture collides with walls 50, 52, and flows toward the fluid outlet 26 which is fluidly connected to the common lubricant transfer conduit 23. The lubricant free heat transfer fluid that is disposed toward a center of the fluid inlet 24 (e.g., along a longitudinal axis of the fluid inlet 24) flows into a nozzle 40 and out fluid outlet 28 to the common suction conduit 25.

The nozzle 40 extends from the fluid outlet 28 toward the fluid inlet 24. In some embodiments, the nozzle 40 has at least a portion with a smaller diameter than the fluid inlet 24. In some embodiments, the nozzle 40 includes at least a portion with a smaller diameter than the fluid inlet 24 such that an inlet to the nozzle 40 is disposed at or about a central region of fluid flow from the fluid inlet 24. In some embodiments, the nozzle 40 can be sized such that a space is maintained between an inner wall of the fluid inlet 24 and an outer wall of the nozzle 40. In some embodiments, the nozzle 40 extends beyond a longitudinal line extending along a longitudinal axis of the fluid outlet 26. In some embodiments, the nozzle 40 can be integrally formed with common suction conduit 25. The sizing includes a radius R2 of the nozzle 40, a length L1 of extension 40A of the nozzle 40, and a length L2 of a transition 40B of the nozzle 40. As illustrated, the radius R1 of the fluid inlet 24 can be larger than a radius R3 of the fluid outlet 28. The fluid outlet 26 has a radius R4 that can also be selected to control a flow of heat transfer fluid that is lubricant rich toward the common lubricant transfer conduit 23. Controlling the location and cross-sectional area of the nozzle 40, the distributed flow from the fluid inlet 24 to the fluid outlets 26, 28 can be controlled for various compressor conditions (e.g., compressor speeds, etc.). For example, controlling an extent to which the nozzle 40 extends toward the fluid inlet 24 as compared to the fluid outlet 26. In the illustrated embodiment, the nozzle 40 and the fluid outlet 26 overlap. In some embodiments, the nozzle 40 and the fluid outlet 26 do not overlap. In some embodiments, an angle θ of expansion of the nozzle 40 can be selected to control a rate of fluid expansion of the heat transfer fluid flowing through the nozzle 40 toward the fluid outlet 28. In general, pressure drop increases as the angle θ increases.

In the illustrated embodiment, there can be a (vertical) space/gap between an end/edge of the extension 40A and an inner surface (both at the fluid inlet 24 side) of the fluid outlet 26 so that the lubricant rich portion can flow into the fluid outlet 26 and the lubricant free portion can flow into the fluid outlet 28. The space/gap can be configured to prevent excess lubricant free portion from flowing into the fluid outlet 26. In some embodiment, the space/gap can range from 0 to 2×R4. In some embodiment, the space/gap can be greater than R4/2 but less than R4.

Testing shows that in a control (e.g., for comparison purpose) heat transfer circuit without the embodiments disclosed herein, lubricant loss can occur within, e.g., five minutes after turning on one compressor and turning off another compressor.

Testing also shows that in a heat transfer circuit with the embodiments disclosed herein, the amount of lubricant can be stabilized under various conditions, e.g., with a lubricant return conduit with adequate restriction to prevent excess gaseous heat transfer fluid from passing through the conduit.

Figure 3A:
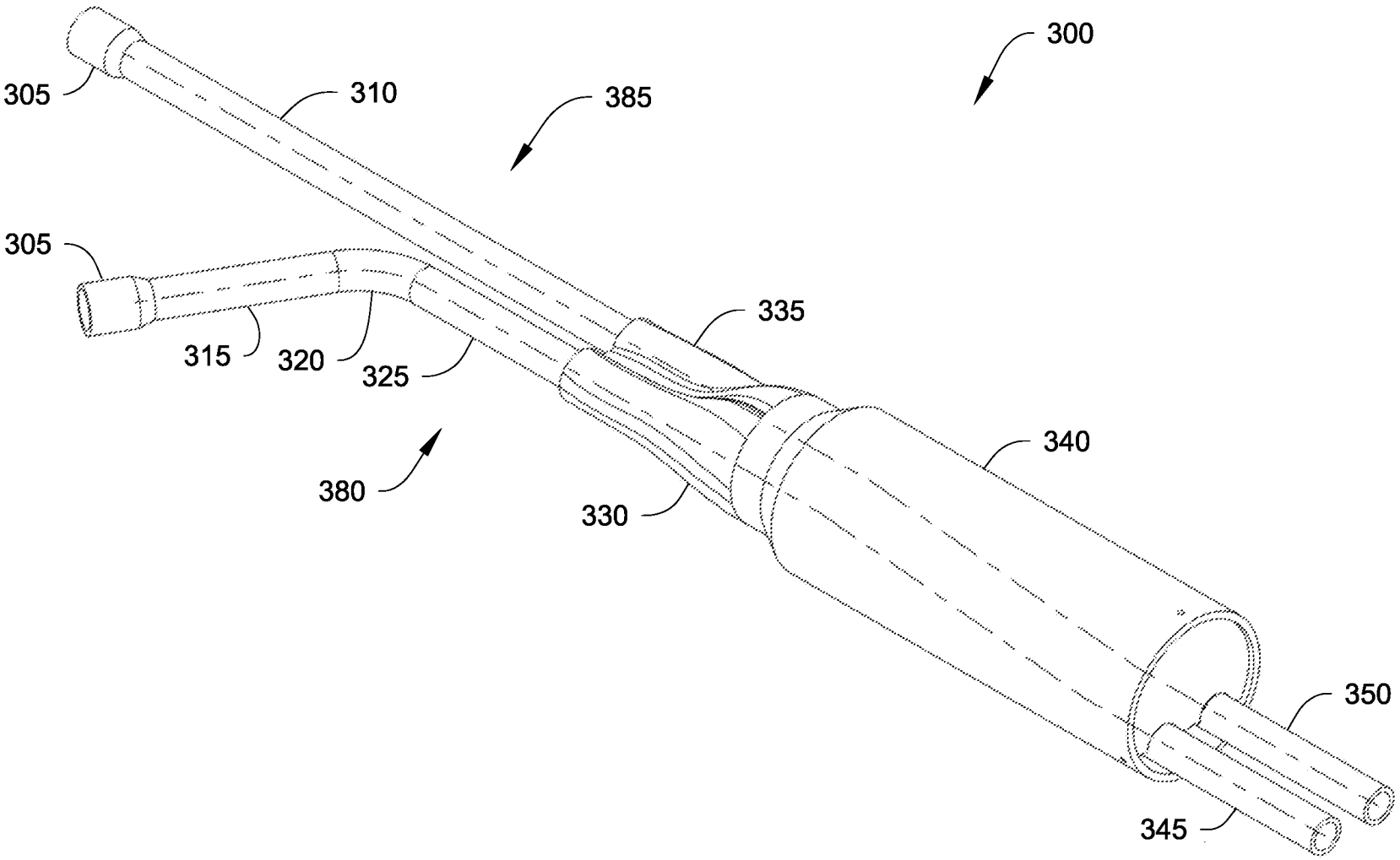
FIGS. 3A-3C illustrate various views of a lubricant transfer conduit assembly, according to an embodiment.
Figure 3B:
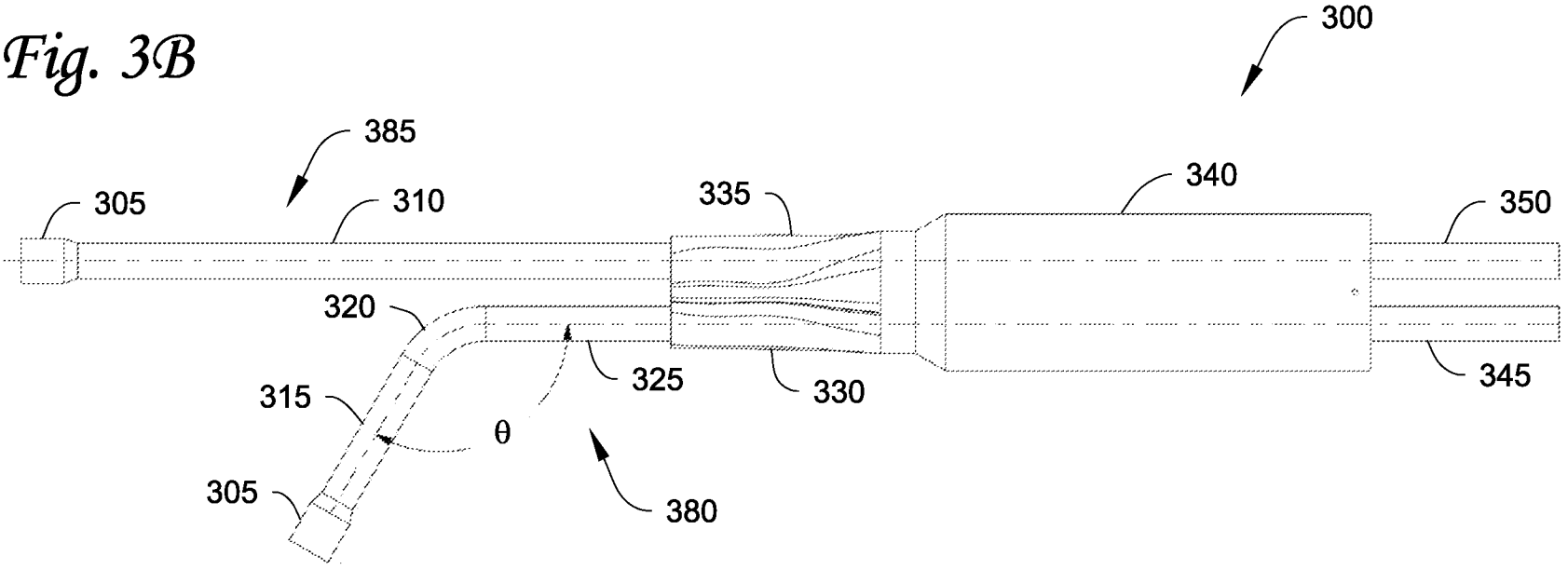
Figure 3C:
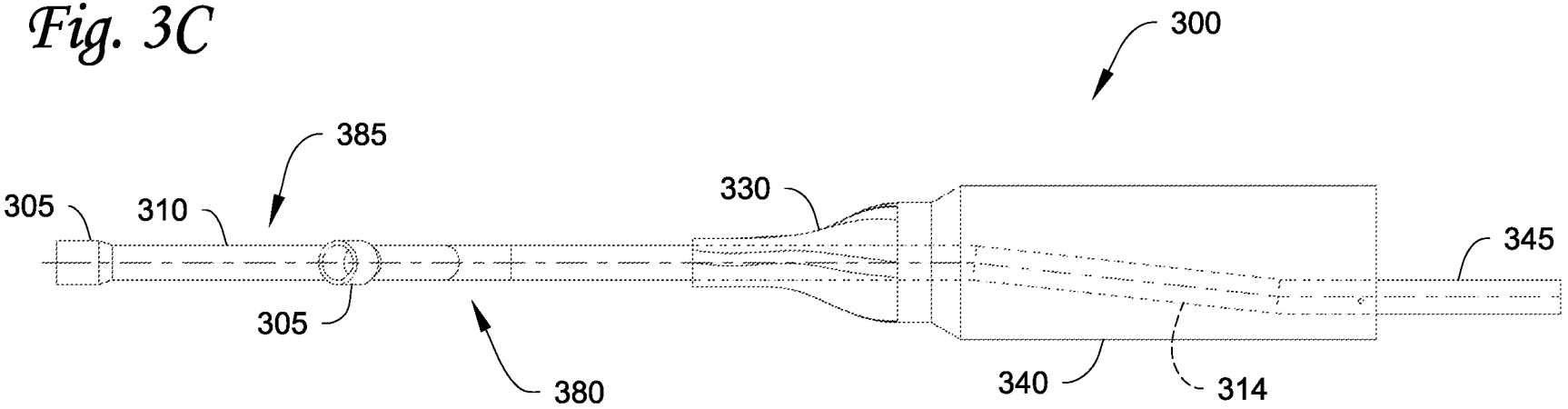

FIGS. 3A-3C illustrate various views of a lubricant transfer conduit assembly 300, according to an embodiment. The lubricant transfer conduit assembly 300 can be used to connect the lubricant sumps 13A, 13B, 13C of FIGS. 1A-1C, and/or connect the lubricant separator 20 and one of the lubricant sumps 13A, 13B, 13C of FIGS. 1A-1C.

FIG. 3A illustrates an isometric view of a lubricant transfer conduit assembly 300, according to an embodiment. FIG. 3B illustrates a side view of the lubricant transfer conduit assembly 300, according to an embodiment. FIG. 3C illustrates another side view of the lubricant transfer conduit assembly 300, according to an embodiment. FIG. 3B and FIG. 3C are side views of the same lubricant transfer conduit assembly 300 but are rotated 90° relative to each other. For simplicity of this specification, reference will be made generally to the features of FIGS. 3A-3C without specific reference to a particular figure unless specifically stated otherwise.

The lubricant transfer conduit assembly 300 includes connector(s) 305, a first conduit 380 and a second conduit 385. The first conduit 380 includes conduit portions 315, 320, 325, and 345. The second conduit 385 includes conduit portions 310 and 350.

Each connector 305 has a first end and a second end. The first end of the connector 305 has a reduced diameter compared with the second end of the connector 305. The conduit portion 315 (and/or 310) is attached, fixed, or otherwise connected to the first end of the connector 305. In an embodiment, the conduit portion 315 (and/or 310) may be brazed to the first end of the connector 305. The second end (with a larger diameter than the first end) of the connector 305 can connect to, e.g., other conduits (not shown) for transferring lubricant. It will be appreciated that the second end of the connector 305 can also have a reduced diameter, similar to the first end of the connector 305, to connect to other conduits for transferring lubricant.

The lubricant transfer conduit assembly 300 also includes a tube 340 having a first end and a second end. The first end of the tube 340 has a reduced diameter compared with the second end of the tube 340. Wrappers 330 and 335 are attached/fixed/connected to the first end of the tube 340 in e.g., a side-by-side fashion.

A part of the second conduit 385 passes through the wrapper 335 and the tube 340. At an end of the wrapper 335 away from the tube 340, the space between an outer surface of the second conduit 385 and an inner surface of the wrapper 335 is sealed (e.g. brazed) to avoid leakage. A portion of the second conduit 385 inside the tube 340 slants from an axis of the tube 340 toward a lower portion of the tube 340.

A part of the first conduit 380 passes through the wrapper 330 and the tube 340. At an end of the wrapper 330 away from the tube 340, the space between an outer surface of the first conduit 380 and an inner surface of the wrapper 330 is sealed (e.g. brazed) to avoid leakage. A portion 341 of the first conduit 380 inside the tube 340 slants from an axis of the tube 340 toward a lower portion of the tube 340. The tube 340 can hold the first conduit 380 and/or the second conduit 385 in place and enable the lubricant transfer conduit assembly 300 to be sealed, such as for example by brazing. The second end of the tube 340 can be brazed to a connector (not shown) of a compressor sump. Once the second end of the tube 340 is brazed into the compressor sump, an interior of the tube 340 is open to the sump pressure.

The conduit portion 350 of the second conduit 385 and the conduit portion 345 of the first conduit 380 are disposed at a lower portion of the tube 340 in a side-by-side fashion. Disposing the conduit portions 350 and 345 at the lower portion of the tube 340 can keep the level of lubricant in the compressor sump(s) lower. Since the compressor sump connection (that connects to the second end of the tube 340) is higher than the conduit portions 350 and 345, this can allow the lubricant level to build up into the motor of the compressor which in turn can increase the lubricant circulation rates in the HVACR system.

In an embodiment, a diameter of the conduits 380 and/or 385 can be, e.g., at or about 0.25 inch (at or about 6.35 millimeters). The diameter of the conduits 380 and/or 385 typically matches a width/diameter of the bypass area of the compressor motor where lubricant can bypass around the motor. The diameter of the conduits 380 and/or 385 can be any suitable size to match the width/diameter of the bypass area of the compressor motor to allow lubricant to flow down through the motor. It will be appreciated that a large diameter (e.g., at or about 1.125 inch (at or about 28.575 millimeters)) of the conduits 380 and/or 385 can vent the compressor sump(s) easily so as to not allow lubricant to come down through the motor of the compressor, e.g. when only one compressor is running. Smaller diameter (e.g., at or about 0.25 inch (at or about 6.35 millimeters)) can reduce venting to allow lubricant to come down through the motor of the compressor, e.g. when only one compressor is running. In an embodiment, a diameter of the second end of the tube 340 can be at or about 1.125 inch (at or about 28.575 millimeters). The diameter of the second end of the tube 340 can be any suitable size to match the size of the connector on the compressor sump.

In an embodiment, the first conduit 380 (e.g., via conduit portion 345) can connect to, e.g., an inlet of a sump of a compressor, and the second conduit 385 (e.g., via conduit portion 350) can connect to, e.g., an outlet of the sump of the compressor. In another embodiment, the first conduit 380 (e.g., via conduit portion 345) can connect to, e.g., an outlet of a sump of a compressor, and the second conduit 385 (e.g., via conduit portion 350) can connect to, e.g., an inlet of the sump of the compressor. It will be appreciated that in one embodiment, the second end of the tube 340 can be brazed to a connector (not shown) of a compressor sump, and the first conduit 380 and the second conduit 385 extend into the compressor sump so that they independently draw lubricant from or drain lubricant into the compressor sump.

The axis of the conduit portion 315 and the axis of the conduit portion 325 form an angle at or about 120°. The angle can help to separate the two brazed joints (a joint of connector 305 and conduit portion 315, and a joint of connector 305 and conduit portion 310). If the two braze joints are to close together, the first brazed joint can be un-brazed during the brazing operation of the joint. The conduit portion 320 is a curved portion connects the conduit portion 315 with the conduit portion 325. Lubricant can flow from one end of the conduit (380 and/or 385) to the other end of the conduit (380 and/or 385).

Referring to FIG. 1A, the heat transfer circuit 10A can have two lubricant transfer conduit assemblies 300. The first lubricant transfer conduit assembly 300 connects to a sump inlet/outlet (e.g., 29B) of the lubricant sump 13B via one of the conduits (380, 385) of the first lubricant transfer conduit assembly 300, and the other one of the conduits (380, 385)

of the first lubricant transfer conduit assembly 300 is not used (e.g., is sealed from leaking lubricant). The lubricant transfer conduit 36 can connect to the one of the conduits (380, 385) of the first lubricant transfer conduit assembly 300 via one connector 305 of the first lubricant transfer conduit assembly 300. The first lubricant transfer conduit assembly 300 is disposed between the lubricant transfer conduit 36 and the sump inlet/outlet (29B).

The second lubricant transfer conduit assembly 300 connects to the inlet/outlet (29A) of the lubricant sump 13A via one of the conduits (380, 385) of the second lubricant transfer conduit assembly 300, and the other one of the conduits (380, 385) of the second lubricant transfer conduit assembly 300 is not used (e.g., is sealed from leaking lubricant). The lubricant transfer conduit 36 can connect to the one of the conduits (380, 385) of the second lubricant transfer conduit assembly 300 via one connector 305 of the second lubricant transfer conduit assembly 300. The second lubricant transfer conduit assembly 300 is disposed between the lubricant transfer conduit 36 and the sump inlet 29A. It will be appreciated that each of 29A, 29B can be the inlet or the outlet of the corresponding sump.

Referring to FIG. 1B, the heat transfer circuit 10B can have two lubricant transfer conduit assemblies 300. The first lubricant transfer conduit assembly 300 connects to a sump inlet (e.g., 29C) of the lubricant sump 13B via one of the conduits (380, 385) of the first lubricant transfer conduit assembly 300, and connects to a sump outlet (29B) of the lubricant sump 13B via the other one of the conduits (380, 385) of the first lubricant transfer conduit assembly 300. The lubricant transfer conduit 23 can connect to the one of the conduits (380, 385) of the first lubricant transfer conduit assembly 300 via one connector 305 of the first lubricant transfer conduit assembly 300. The lubricant transfer conduit 36 can connect to the other one of the conduits (380, 385) of the first lubricant transfer conduit assembly 300 via the other connector 305 of the first lubricant transfer conduit assembly 300. The first lubricant transfer conduit assembly 300 is disposed between the lubricant transfer conduits (23 and/or 36) and the sump inlet/outlet (29C and/or 29B).

The second lubricant transfer conduit assembly 300 connects to the inlet of the lubricant sump 13A via one of the conduits (380, 385) of the second lubricant transfer conduit assembly 300, and the other one of the conduits (380, 385) of the second lubricant transfer conduit assembly 300 is not used (e.g., is sealed from leaking lubricant). The lubricant transfer conduit 36 can connect to the one of the conduits (380, 385) of the second lubricant transfer conduit assembly 300 via one connector 305 of the second lubricant transfer conduit assembly 300. The second lubricant transfer conduit assembly 300 is disposed between the lubricant transfer conduit 36 and the sump inlet 29A. It will be appreciated that each of 29A, 29B, 29C can be the inlet or the outlet of the corresponding sump.

Referring to FIG. 1C, the heat transfer circuit 10C can have three lubricant transfer conduit assemblies 300. The first lubricant transfer conduit assembly 300 connects to a sump inlet (e.g., 29C) of the lubricant sump 13B via one of the conduits (380, 385) of the first lubricant transfer conduit assembly 300, and connects to a sump outlet (29B) of the lubricant sump 13B via the other one of the conduits (380, 385) of the first lubricant transfer conduit assembly 300. The lubricant transfer conduit 23 can connect to the one of the conduits (380, 385) of the first lubricant transfer conduit assembly 300 via one connector 305 of the first lubricant transfer conduit assembly 300. The lubricant transfer conduit 36A can connect to the other one of the conduits (380, 385) of the first lubricant transfer conduit assembly 300 via the other connector 305 of the first lubricant transfer conduit assembly 300. The first lubricant transfer conduit assembly 300 is disposed between the lubricant transfer conduits (23 and/or 36A) and the sump inlet/outlet (29C and/or 29B).

The second lubricant transfer conduit assembly 300 connects to a sump inlet (e.g., 29F) of the lubricant sump 13C via one of the conduits (380, 385) of the second lubricant transfer conduit assembly 300, and connects to a sump outlet (29E) of the lubricant sump 13C via the other one of the conduits (380, 385) of the second lubricant transfer conduit assembly 300. The lubricant transfer conduit 36A can connect to the one of the conduits (380, 385) of the second lubricant transfer conduit assembly 300 via one connector 305 of the second lubricant transfer conduit assembly 300. The lubricant transfer conduit 36B can connect to the other one of the conduits (380, 385) of the second lubricant transfer conduit assembly 300 via the other connector 305 of the second lubricant transfer conduit assembly 300. The second lubricant transfer conduit assembly 300 is disposed between the lubricant transfer conduits (36A and/or 36B) and the sump inlet/outlet (29E and/or 29F).

The third lubricant transfer conduit assembly 300 connects to the inlet 29D of the lubricant sump 13A via one of the conduits (380, 385) of the third lubricant transfer conduit assembly 300, and the other one of the conduits (380, 385) of the third lubricant transfer conduit assembly 300 that connects to the outlet 29A of the lubricant sump 13A. It will be appreciated that the outlet 29A may not be used (e.g., sealed from leaking lubricant). The lubricant transfer conduit 36B can connect to the one of the conduits (380, 385) of the third lubricant transfer conduit assembly 300 via one connector 305 of the third lubricant transfer conduit assembly 300. The third lubricant transfer conduit assembly 300 is disposed between the lubricant transfer conduit 36B and the sump inlet/outlet (29D and/or 29A). It will be appreciated that each of 29A, 29B, 29C, 29D, 29E can be the inlet or the outlet of the corresponding sump.

Aspects:

It is noted that any one of aspects 1-10 below can be combined with any one of aspects 19.

Aspect 1. A heating, ventilation, air conditioning, and refrigeration (HVACR) system, the system comprising:

a first compressor, a second compressor, a condenser, an expansion device, an evaporator, and a lubricant separator fluidly connected;

wherein the first compressor and the second compressor are arranged in parallel, the first compressor includes a first lubricant sump and a first suction inlet, the second compressor includes a second lubricant sump and a second suction inlet, and the lubricant separator is disposed between the evaporator and the first and second compressors, the lubricant separator includes a fluid inlet and two fluid outlets, a first of the two fluid outlets is fluidly connected to at least one of the first and second lubricant sumps, a second of the two fluid outlets is fluidly connected to the first and second suction inlets, the second fluid outlet includes a nozzle disposed within a flow passage of the lubricant separator such that a space is maintained between an outer surface of the nozzle and an inner surface of the flow passage.

Aspect 2. The system according to aspect 1, wherein the first compressor is a variable speed compressor and the second compressor is a fixed speed compressor.

Aspect 3. The system according to aspect 1, wherein both the first compressor and the second compressor are fixed speed compressors.

Aspect 4. The system according to any one of aspects 1-3, wherein the first and second compressors are scroll compressors.

Aspect 5. The system according to any one of aspects 1-4, wherein the nozzle extends from the second of the two fluid outlets toward the fluid inlet.

Aspect 6. The system according to any one of aspects 1-5, wherein a longitudinal axis of the second of the two fluid outlets is co-linear with a longitudinal axis of the fluid inlet.

Aspect 7. The system according to any one of aspects 1-6, wherein a longitudinal axis of the first of the two fluid outlets is perpendicular to the fluid inlet.

Aspect 8. The system according to any one of aspects 1-7, wherein a radius of the fluid inlet is greater than a radius of the second of the two fluid outlets.

Aspect 9. The system according to any one of aspects 1-8, further comprising a third compressor, wherein the first compressor, the second compressor, and the third compressor are arranged in parallel.

Aspect 10. The system according to any one of aspects 1-9, further comprising a first lubricant transfer conduit and a second lubricant transfer conduit, wherein the first of the two fluid outlets is fluidly connected to the first lubricant sump via the first lubricant transfer conduit, the first lubricant sump is fluidly connected to the second lubricant sump via the second lubricant transfer conduit.

Aspect 11. A method for separating and returning lubricant for a heating, ventilation, air conditioning, and refrigeration (HVACR) system, the method comprising:

separating a flow of a heat transfer fluid and lubricant mixture into a lubricant rich portion and a lubricant free portion;

directing the lubricant rich portion to at least one of a first lubricant sump of a first compressor and a second lubricant sump of a second compressor; and directing the lubricant free portion to a first suction inlet of the first compressor and a second suction inlet of the second compressor, wherein the first and second compressors are arranged in parallel in a heat transfer circuit.

Aspect 12. The method according to aspect 11, wherein the separating the flow is completed using a lubricant separator includes a fluid inlet and two fluid outlets, a first of the two fluid outlets is fluidly connected to at least one of the first and second lubricant sumps, a second of the two fluid outlets is fluidly connected to the first and second suction inlets, the second fluid outlet includes a nozzle disposed within a flow passage of the lubricant separator such that a space is maintained between an outer surface of the nozzle and an inner surface of the flow passage.

Aspect 13. The method according to aspect 11 or aspect 12, wherein the first compressor is a variable speed compressor and the second compressor is a fixed speed compressor.

Aspect 14. The method according to aspect 11 or aspect 12, wherein both the first compressor and the second compressor are fixed speed compressors.

Aspect 15. The method according to any one of aspects 11-14, wherein the first and second compressors are scroll compressors.

Aspect 16. The method according to any one of aspects 12-15, wherein the nozzle extends from the second of the two fluid outlets toward the fluid inlet.

Aspect 17. The method according to any one of aspects 12-16, wherein a longitudinal axis of the second of the two fluid outlets is co-linear with a longitudinal axis of the fluid inlet.

Aspect 18. The method according to any one of aspects 12-17, wherein a longitudinal axis of the first of the two fluid outlets is perpendicular to the fluid inlet.

Aspect 19. The method according to any one of aspects 12-18, wherein a radius of the fluid inlet is greater than a radius of the second of the two fluid outlets.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A heating, ventilation, air conditioning, and refrigeration (HVACR) system, the system comprising:

a first compressor, a second compressor, a condenser, an expansion device, an evaporator, and a lubricant separator fluidly connected;

wherein the first compressor and the second compressor are arranged in parallel, the first compressor includes a first lubricant sump and a first suction inlet, the second compressor includes a second lubricant sump and a second suction inlet, and the lubricant separator is disposed between the evaporator and the first and second compressors, the lubricant separator includes a fluid inlet and two fluid outlets, a first of the two fluid outlets is connected to a sump inlet of at least one of the first and second lubricant sumps via a first lubricant transfer conduit, a second of the two fluid outlets is connected to the first and second suction inlets via a suction line, the second fluid outlet includes a nozzle disposed within a flow passage of the lubricant separator such that a space is maintained between an outer surface of the nozzle and an inner surface of the flow passage.

2. The system according to claim 1, wherein the first compressor is a variable speed compressor and the second compressor is a fixed speed compressor.

3. The system according to claim 1, wherein both the first compressor and the second compressor are fixed speed compressors.

4. The system according to claim 1, wherein the first and second compressors are scroll compressors.

5. The system according to claim 1, wherein the nozzle extends from the second of the two fluid outlets toward the fluid inlet.

6. The system according to claim 1, wherein a longitudinal axis of the second of the two fluid outlets is co-linear with a longitudinal axis of the fluid inlet.

7. The system according to claim 1, wherein a longitudinal axis of the first of the two fluid outlets is perpendicular to the fluid inlet.

8. The system according to claim 1, wherein a radius of the fluid inlet is greater than a radius of the second of the two fluid outlets.

9. The system according to claim 1, further comprising a third compressor, wherein the first compressor, the second compressor, and the third compressor are arranged in parallel.

10. The system according to claim 1, further comprising a second lubricant transfer conduit, wherein the first of the two fluid outlets is connected to the first lubricant sump via the first lubricant transfer conduit, the first lubricant sump is connected to the second lubricant sump via the second lubricant transfer conduit.

11. A method for separating and returning lubricant for a heating, ventilation, air conditioning, and refrigeration (HVACR) system, the method comprising:

separating a flow of a heat transfer fluid and lubricant mixture into a lubricant rich portion and a lubricant free portion;

directing the lubricant rich portion to a sump inlet of at least one of a first lubricant sump of a first compressor and a second lubricant sump of a second compressor via a first lubricant transfer conduit; and directing the lubricant free portion to a first suction inlet of the first compressor and a second suction inlet of the second compressor via a suction line, wherein the first and second compressors are arranged in parallel in a heat transfer circuit.

12. The method according to claim 11, wherein the separating the flow is completed using a lubricant separator includes a fluid inlet and two fluid outlets, a first of the two fluid outlets is connected to the sump inlet of at least one of the first and second lubricant sumps, a second of the two fluid outlets is connected to the first and second suction inlets, the second fluid outlet includes a nozzle disposed within a flow passage of the lubricant separator such that a space is maintained between an outer surface of the nozzle and an inner surface of the flow passage.

13. The method according to claim 11, wherein the first compressor is a variable speed compressor and the second compressor is a fixed speed compressor.

14. The method according to claim 11, wherein both the first compressor and the second compressor are fixed speed compressors.

15. The method according to claim 11, wherein the first and second compressors are scroll compressors.

16. The method according to claim 12, wherein the nozzle extends from the second of the two fluid outlets toward the fluid inlet.

17. The method according to claim 12, wherein a longitudinal axis of the second of the two fluid outlets is co-linear with a longitudinal axis of the fluid inlet.

18. The method according to claim 12, wherein a longitudinal axis of the first of the two fluid outlets is perpendicular to the fluid inlet.

19. The method according to claim 12, wherein a radius of the fluid inlet is greater than a radius of the second of the two fluid outlets.

20. The system according to claim 1, further comprising a second lubricant transfer conduit, wherein the first lubricant sump is connected to the second lubricant sump via the second lubricant transfer conduit, the first of the two fluid outlets is connected to the sump inlet of one of the first and second lubricant sumps that has a higher operation pressure, a diameter of the second lubricant transfer conduit is smaller than a diameter of the suction line.

* * * * *